US010790610B1

(12) United States Patent
Li et al.

(10) Patent No.: US 10,790,610 B1
(45) Date of Patent: Sep. 29, 2020

(54) CONNECTOR FOR HIGH DATA TRANSMISSION RATE

(71) Applicant: Sichuan University, Chengdu, Sichuan (CN)

(72) Inventors: Wenqiang Li, Sichuan (CN); Sitong Ling, Sichuan (CN); Yan Li, Sichuan (CN); Wu Zhao, Sichuan (CN); Zhe Li, Sichuan (CN); Mengkui Li, Sichuan (CN)

(73) Assignee: Sichuan University, Chengdu (CN)

( * ) Notice: Subject to any disclaimer, the term of this patent is extended or adjusted under 35 U.S.C. 154(b) by 0 days.

(21) Appl. No.: 16/716,512

(22) Filed: Dec. 17, 2019

(51) Int. Cl.
*H01R 13/514* (2006.01)
*H01R 24/30* (2011.01)
*H01R 13/6586* (2011.01)

(52) U.S. Cl.
CPC ..... *H01R 13/514* (2013.01); *H01R 13/6586* (2013.01); *H01R 24/30* (2013.01)

(58) Field of Classification Search
CPC ..... H01R 13/6586; H01R 13/514; H01R 13/6578; H01R 13/6594
USPC ..... 439/607.05, 0.07
See application file for complete search history.

(56) References Cited

U.S. PATENT DOCUMENTS 6,347,962 B1 * 2/2002 Kline ..... H01R 13/6473 439/607.07
6,808,420 B2 * 10/2004 Whiteman, Jr. ... H01R 13/6587 439/108
7,416,447 B1 * 8/2008 Chen ..... H01R 13/6587 439/108
7,422,444 B1 * 9/2008 Johnescu ..... H01R 12/585 439/78
8,444,436 B1 * 5/2013 Cohen ..... H05K 1/115 439/607.08
8,641,448 B2 * 2/2014 Lappoehn ..... H01R 13/6471 439/607.09

FOREIGN PATENT DOCUMENTS

| | | | |
|---|---|---|---|
| CN | 1656653 | A | 8/2005 |
| CN | 201008051 | Y | 1/2008 |
| CN | 101383467 | A | 3/2009 |
| CN | 106099546 | A | 11/2016 |
| CN | 106450853 | A | 2/2017 |
| CN | 107431298 | A | 12/2017 |
| WO | 02061888 | A1 | 8/2002 |
| WO | 2014035755 | A1 | 3/2014 |

* cited by examiner

*Primary Examiner* — Hien D Vu
(74) *Attorney, Agent, or Firm* — Wayne & Ken, LLC; Tony Hom

(57) ABSTRACT

Disclosed is a connector for high data transfer rate, including a female element, a male element. The female element includes a housing, a plurality of sheets and a first shielding plate. The male element includes a base, a differential signal contact and a second shielding plate. At least two sheets are provided on the housing, and the first shielding plate is provided between adjacent sheets. The second shielding plate corresponding to the sheets is provided on the base. A signal pin is provided at a bottom of the sheets. The differential signal contact is provided in the base. The housing is matched with the base, and the signal pin is configured to contact the differential signal contact. The connector of the present invention improves space utilization rate in the longitudinal direction, assembly efficiency and fault tolerance rate thereof.

3 Claims, 6 Drawing Sheets

CONNECTOR FOR HIGH DATA TRANSMISSION RATE

CROSS-REFERENCE TO RELATED APPLICATIONS

This application claims the benefit of priority from Chinese Patent Application No. 201910219099.7, filed on Mar. 21, 2019. The content of the aforementioned application, including any intervening amendments thereto, is incorporated herein by reference in its entirety.

TECHNICAL FIELD

This application relates to electronic components, more particularly to a connector for high-speed data transmission.

BACKGROUND OF THE INVENTION

Connectors are commonly used components in electronic engineering as well as key components for current or signal connection. The connector is initially provided at the blocking or disconnecting parts of the circuit to simplify the assembling of electronic devices and facilitate the repairing in subsequent stages. Two separate circuits are connected by the connector to allow currents to flow. Generally, the connection of the connector is achieved by a male element and a female element; and the male element and female element are respectively connected to two active devices, so that currents or signals are transferred in the two active devices.

Currently, the connectors are often used in high-performance environments, that is, the data rate is high and the amount of transmission per unit time is large. The existing connectors are provided with a plurality of terminals and are installed in various forms to ensure the data transmission rate. Therefore, the connectors are correspondingly required to have a proper installation way and higher fault tolerance rate to avoid crosstalk, so that the connectors are more suitable for high-speed data transfer.

SUMMARY OF THE INVENTION

The present invention aims to provide a connector to improve a utilization rate in a longitudinal direction, assembly efficiency and fault tolerance rate thereof.

In order to overcome above technical problems, the present invention provides the following technical solutions.

Provided is a connector, comprising a female element, a male element; wherein the female element comprises a housing, a plurality of sheets and a first shielding plate; the male element comprises a base, a differential signal contact and a second shielding plate; at least two sheets are provided on the housing, and the first shielding plate is provided between adjacent sheets; the second shielding plate corresponding to the sheets is provided on the base; a signal pin is provided at a bottom of the sheet; the differential signal contact is provided in the base; the housing is matched with the base; and the signal pin is configured to contact the differential signal contact. Therefore, signals are inputted by a plurality of terminals provided on the sheet and outputted by the signal pin; and by reducing the height of the differential signal contact in the vertical direction, the height of the connector after the male element and the female element are fitted is reduced, such that the space utilization in the longitudinal direction is improved and the terminal number is increased to meet the requirement of the transmission rate; the first shielding plate reduces the electromagnetic interference between the sheets to ensure the insulating property; the second shielding plate reduces the electromagnetic interference between the differential signal contacts in pairs to ensure the insulating property; and the connector can be quickly assembled since the housing is matched with the base.

In some embodiments, the housing comprises a pin hole, a spacer and a shielding plate slot; where the spacer is arranged between the shielding plate slot and the pin hole; the signal penetrates through the pin hole; the first shielding plate penetrates through the shielding plate slot; and the spacer is configured to insulate the signal pin from the first shielding plate.

In some embodiments, a pin slot corresponding to the signal pin is provided on the base; an end slot corresponding to a shielding plate slot of the housing is provided on the base; and the base comprises a signal pin slot corresponding to an opening of the signal pin, and the differential signal contact is arranged in the signal pin slot.

In some embodiments, the differential signal contact is L-shaped and comprises a first end portion and a second end portion; the second end portion matches with the signal pin slot; and the first end portion extends towards the bottom of the base to connect with an external circuit.

In some embodiments, the mating portion comprises a first arc and a second arc; the first arc is arranged in the shielding plate slot; and the second arc is inserted in the end slot through the shielding plate slot and contacts the second shielding plate.

In some embodiments, a protrusion is provided on an outer wall of the housing, and a groove is provided on a side wall of the base; wherein the protrusion is matched with the groove.

Compared with the prior art, the present invention has the following beneficial effects.

The connector of the present invention has a physical structure which is well fitted, and an improved space utilization along the longitudinal direction. At the same time, the length of the differential signal contact is significantly reduced. The assembly for the connector is improved due to the fitting of the housing and the base. Meanwhile, the signal pin of the female element matches with the second end portion of the differential signal contact of the male element, such that a sufficient matching distance is ensured, improving the fault tolerance rate of the connector.

REFERENCE NUMERALS

Figure 1:
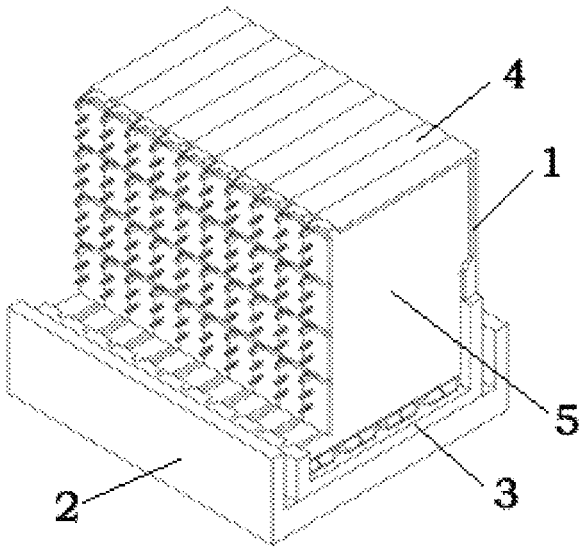
FIG. 1 is a perspective view of a connector for high-speed data transmission of the present invention.
Figure 2:
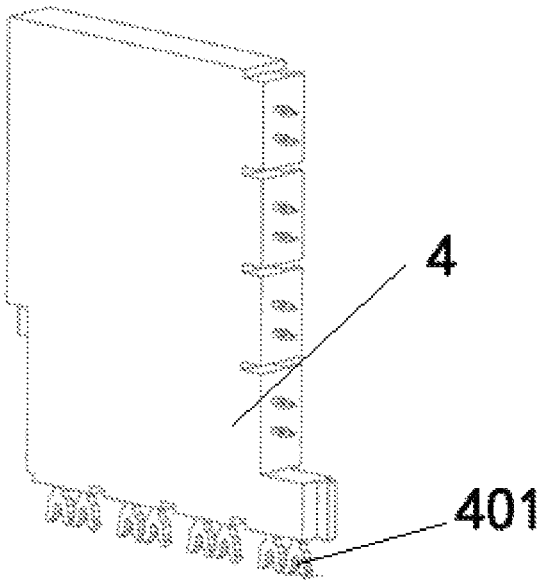
FIG. 2 is a perspective view of a sheet in FIG. 1.
Figure 3:
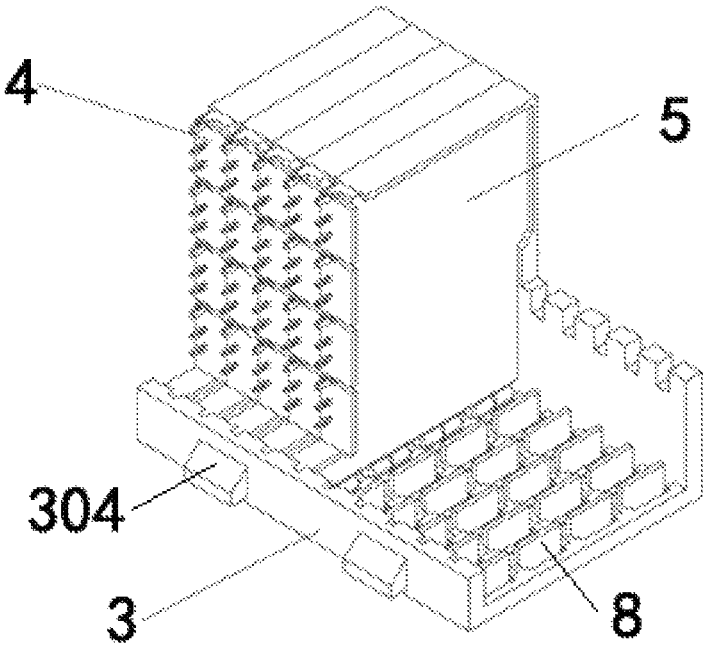
FIG. 3 is a perspective view of a female element in FIG. 1.
Figure 4:
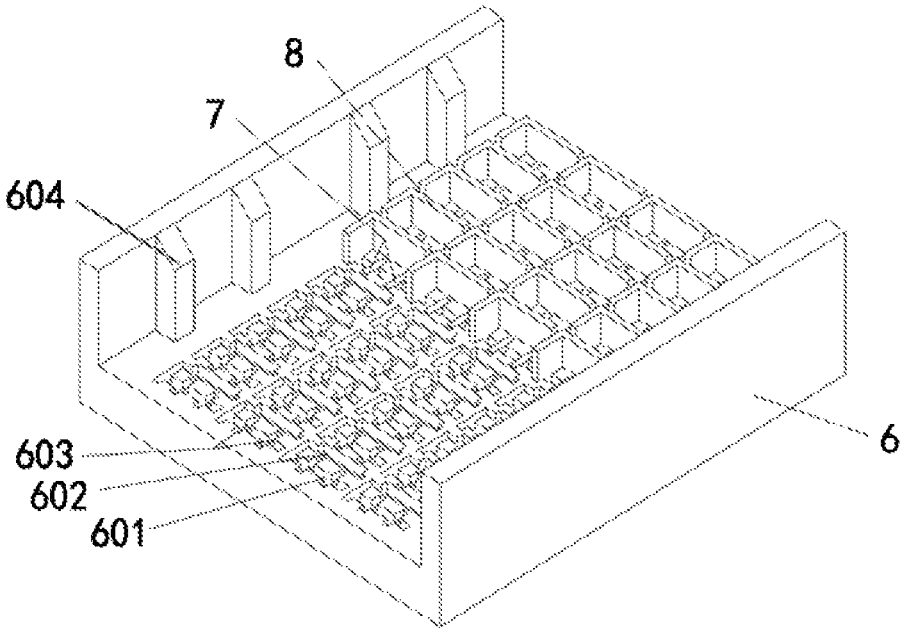
FIG. 4 is a perspective view of a male element of the present invention.

1, female element; 2, male element; 3, housing; 4, sheet; 5, first shielding plate; 6, base; 7, differential signal contact; 8, second shielding plate; 301, pin hole; 302, spacer; 303, shielding plate slot; 304, protrusion; 401; signal pin; 501, mating portion; 502, first arc; 503, second arc; 601, pin slot; 602, end slot; 603, signal pin slot; 604, groove; 701, first end portion; 702, second end portion.

DETAILED DESCRIPTION OF EMBODIMENTS

The present invention will be further described in detail below with reference to the accompanying drawings and embodiments. It should be understood that the embodiments described herein are merely illustrative and are not intended to limit the scope of the invention.

Example 1

As shown in FIGS. 1-4 and 12, illustrated is an embodiment of a connector, comprising a female element 1 and a male element 2 which are perpendicular to each other. The female element 1 comprises a housing 3 made of insulating materials, a plurality of sheets 4 and a first shielding plate 5. The male element 2 comprises a base 6, a plurality of differential signal contacts 7 and a second shielding plate 8. At least two sheets 4 are provided on the housing 3, and the first shielding plate 5 is provided between adjacent sheets 4. The base 6 is provided with the second shielding plate 8 corresponding to the sheets 4. Signal pins 401 are provided at a bottom of the sheet 4. The differential signal contacts 7 are provided in the base 6. The housing 3 is fitted with the base 6. The signal pins 401 are configured to contact the differential signal contacts 7, and based on different transmission requirements, the differential signal contacts 7 may be made of different materials, such as plated alloys or copper alloys.

The housing 3 is a carrier of the female element 1 and is made of plastic. The sheet 4 is a contact, and is mounted on the housing 3 at a required interval along a longitudinal direction. The first shielding plate 5 is configured to insulate the sheets 4, so that insulation between the sheets 4 is ensured to prevent crosstalk. The base 6 is a carrier of the male element 2. The differential signal contacts 7 are mounted in pairs on the base 6, and the differential signal contacts which are in pairs are insulated by the second shielding plate 8.

Specifically, a plurality of terminals are provided on the sheets 4. When the data transmission rate is increased, the impact of capacitance and impedance is intensified, and a signal on one terminal interferes that of adjacent terminals thereof, so that crosstalk is caused, affecting signal integrity of the adjacent terminal. In order to ensure the signal integrity, the terminal adapts the differential signal pairs, and the second shielding plate 8 also has grounding and shielding functions. A ground pin corresponding to the terminal is provided on the second shielding plate 8 and arranged on a side of the terminal to reduce the crosstalk. The second shielding plate 8 is L-shaped, and the second shielding plate 8 and the first shielding plate 5 surround contact points of the sheets 4 and the differential signal contacts 7 that are in pairs, thereby avoiding mutual interference between pairs of the differential signal contacts 7. Epoxy adhesives can be adopted for internal fixing and sealing, which makes the assembly easier.

Example 2

Figure 5:
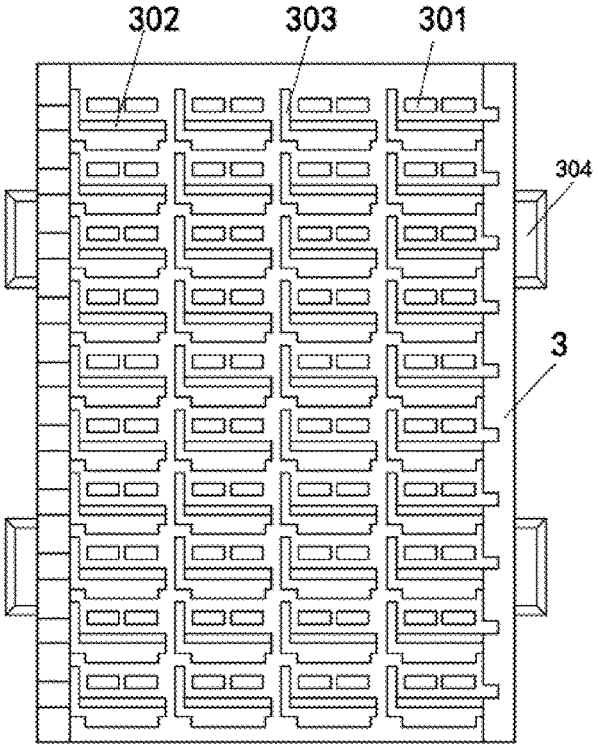
FIG. 5 is a schematic diagram of a housing of the present invention.
Figure 7:
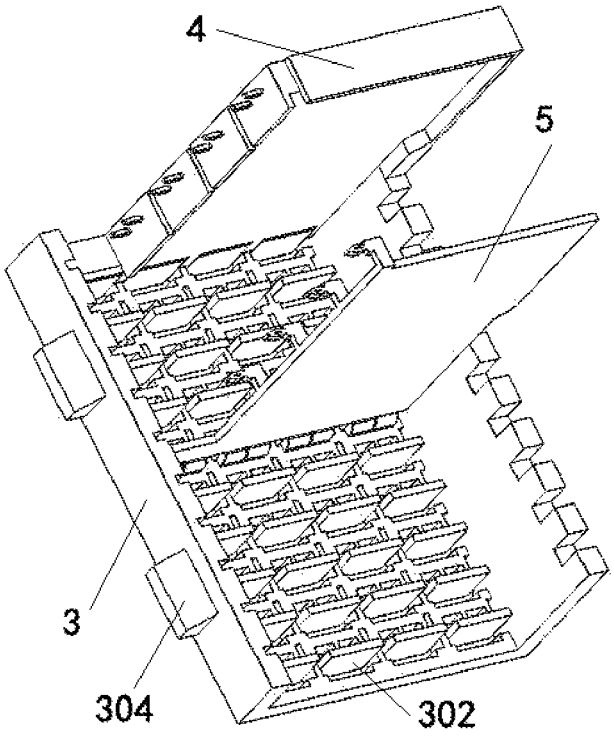
FIG. 7 is a schematic diagram showing an assembling of the base of the present invention.

As shown in FIGS. 5 and 7, based on Example 1, this embodiment is provided to illustrate the connection between the female element 1 and the male element 2. The housing 3 is provided with a pin hole 301, a spacer 302 and a shielding plate slot 303. The spacer 302 is arranged between the shielding plate slot 303 and the pin hole 301. The signal pin 401 penetrates the pin hole 301. The first shielding plate 5 is inserted in the shielding plate slot 303. The spacer 302 is configured to insulate the signal pin 401 from the first shielding plate 5. The supporting housing 3 not only provides mechanical protection for the connector but also facilitates calibrations for the male element 2 and the female element 1 when assembling. The signal pin 401 penetrates through the pin hole 301 to connect with the male element 2. The shielding plate slot 303 is a through hole, so that the first shielding plate 5 contacts the male element 2 through the housing 3. An edge of a bent portion of the signal pin 401 exceeds a bottom of the housing 3, such that the signal pin 401 contacts the male element 2. Further, a partially conductive insulating surface is formed on the bottom of the housing 3, improving the reliability of the connector.

Figure 6:
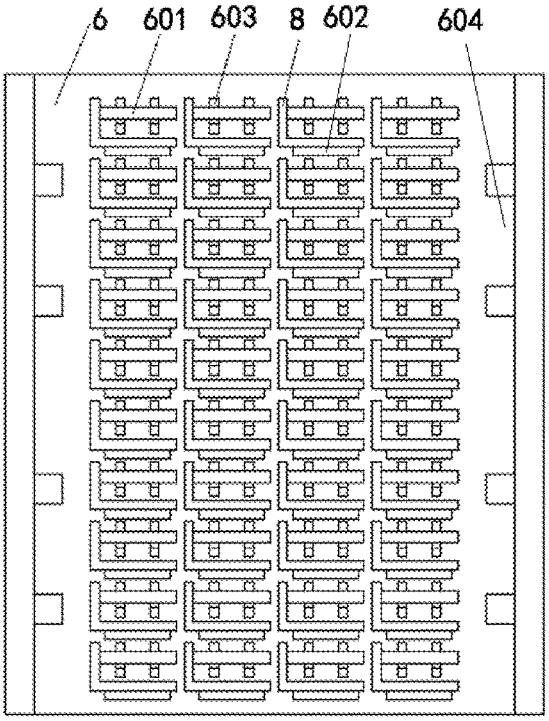
FIG. 6 is a schematic diagram of a base of the present invention.

Further, as shown in FIG. 6, in some embodiments, the base 6 is provided with a pin slot 601 corresponding to the signal pin 401, and an end slot 602 corresponding to the shielding plate slot 303. The male base 6 is provided with a signal pin slot 603 corresponding to an opening of the signal pin 401, and the differential signal contact 7 is arranged in the signal pin slot 603.

Left and right planes of the shield plate slot 303 of the housing 3 are respectively flush with left and right planes of the pin slot 601. The calibration and assembly can be easily conducted by users since the base 6 corresponds to the housing 3. The pin slot 601 is interlaced with the signal pin slot 603, and the signal pin 401 at a lower end of the sheet 4 is accommodated in the pin slot 601, and the signal pin slot 603 is for placing the differential signal contact 7, where an upper end of the differential signal contact 7 is flush with or lower than an opening of the signal pin slot 603, and the signal pin 401 mates with the differential signal contact 7, such that a signal or energy can flow between the signal pin 401 and the differential signal contact 7.

Figure 8:
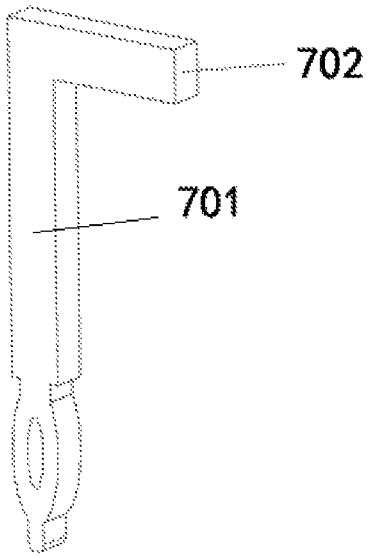
FIG. 8 is a perspective view of a differential signal contact of the present invention.
Figure 9:
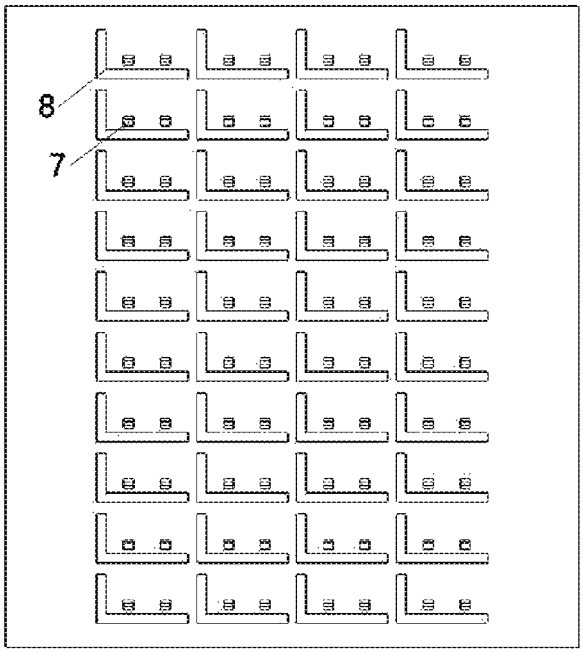
FIG. 9 is a schematic diagram showing a bottom of the base of the present invention.

Further, as shown in FIGS. 8 and 9, in order to ensure the stability of the installation of the differential signal contact 7, the differential signal contact 7 is designed to be L-shaped and comprises a first end 701 and a second end 702. A size of the second end 702 fits with that of the signal pin slot 603, and the first end 701 extends towards the bottom of the base 6 to connect with an external circuit. The differential signal contact 7 is bent to be L-shaped, such that the length of the differential signal contact 7 in the vertical direction is reduced and the height of the connector after assembling is reduced, improving the space utilization in the longitudinal direction. The second end portion 702 of the differential signal contact 7 is limited by the signal pin slot 603 to prevent the differential signal contact 7 from swaying after installation. An upper end of the first end portion 701 is connected to the second end portion 702, and a lower end of the first end portion 701 extends towards a bottom of the base 6 and is provided with a terminal to connect with the external circuit.

Example 3

Figure 10:
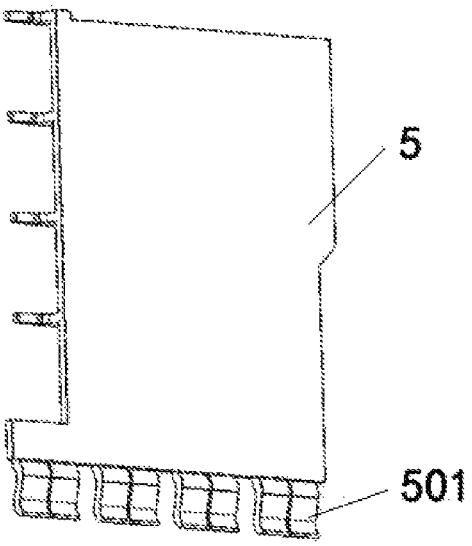
FIG. 10 is a schematic diagram of a first shielding plate of the present invention.
Figure 11:
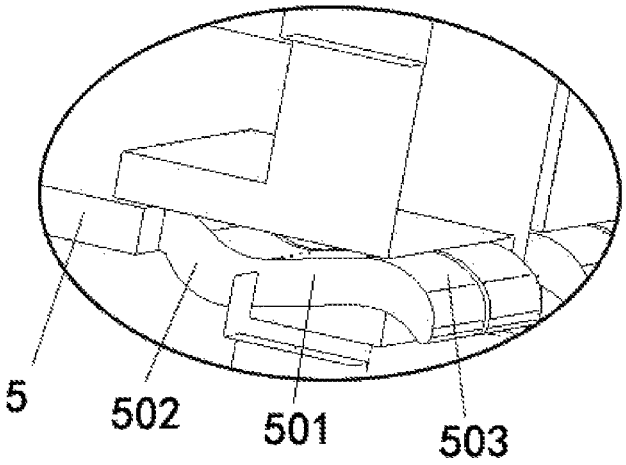
FIG. 11 is a schematic diagram showing an assembling of the first shielding plate of the present invention.
Figure 12:
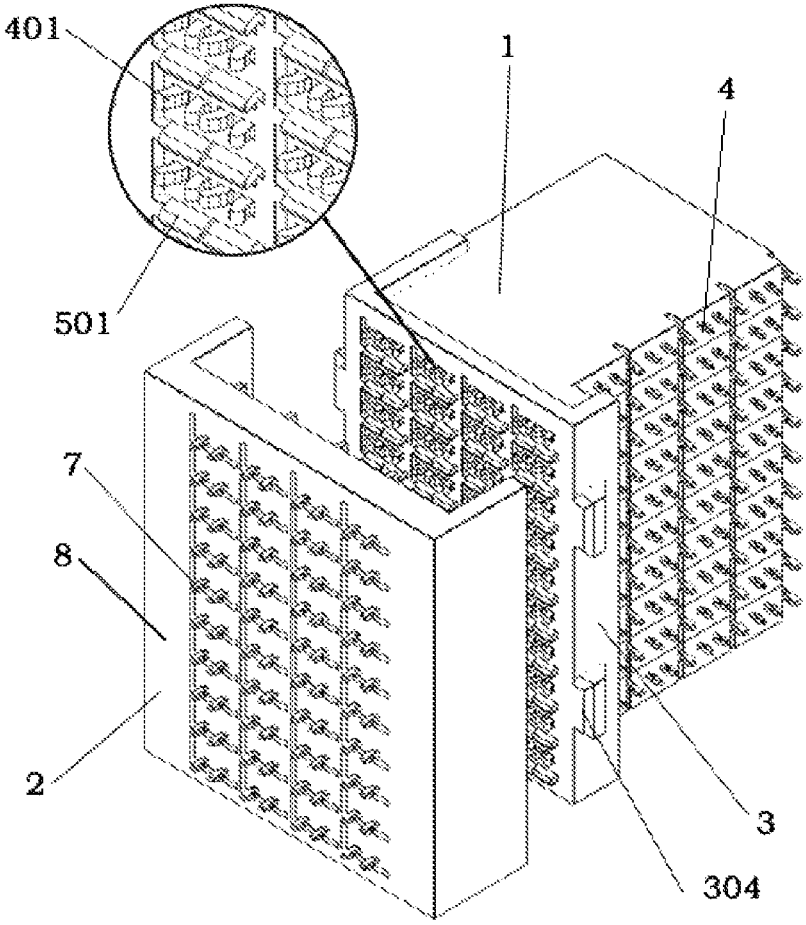
FIG. 12 is a schematic diagram showing an assembling of the connector of the present invention.

As shown in FIGS. 10-11, a mating portion 501 is further provided on a lower end of the first shielding plate 5 to cooperate with the second shielding plate 8. The mating portion 501 is inserted into the end slot 602 through the shielding plate slot 303. The mating portion 501 comprises a first arc 502 and a second arc 503. The first arc 502 is arranged in the shielding plate slot 303 and the second arc 503 is inserted in the end slot 602 through the shielding plate slot 303 and contacts the second shielding plate 8. The mating portion 501 is the connection hub of the first shielding plate 5 and the second shielding plate 8, and is housed in the end slot 602.

The first arc 502 is gradually inserted into the shielding plate slot 303 along with the mating portion 501 without contacting the shielding plate slot 303. The mating portion 501 ensures the installation of the first shielding plate 5 to have a good mechanical property, and the mating portion is easy to be removed and fixed.

Specifically, the second arc 503 is in contact with the second shielding plate 8 through the shielding plate slot 303, and the lower end of the second arc 503 gradually enters the end slot 602 without contacting the end slot 602. A protruded part of the second arc 503 contacts the second shielding plate 8. The first shielding plate 5 is effectively connected to the second shielding plate 8 via the mating portion 501. In addition, due to the spacer 302, the signal pin 401 is completely insulated from the first arc 502 and the second arc 503, such that the crosstalk signal of the female element 1 can be conducted away by grounding after such signal is transmitted to the male element 2.

Example 4

Referring to FIGS. 1-12, a protrusion 304 is provided on an outer wall of the housing 3, and a groove 604 is provided on a side wall of the base 6. The protrusion 304 is matched with the groove 604 in order to further improve the assembly efficiency. The groove 604 is formed by baffles which are opposite to each other and are provided on an inner wall of the base 6, and sizes of the groove 604 and the protrusion 304 are fitted with each other. When the housing 3 is embedded in the base 6, the protrusion 304 is limited or positioned by the groove 604, so that the shaking is avoided, which assists the assembling, thus improving the assembly efficiency of the connector.

It should be understood that "an embodiment", "another embodiment", "embodiment", "preferred embodiment", etc. used herein are referred to as comprising at least one embodiment in which specific features, structures, or characteristics are described generally by way of illustration in the present application. The same description used in the present invention does not necessarily refer to the same embodiment. Any other embodiments based on those embodiments for illustrating the specific features, structures or characteristics of the present invention shall fall within the scope of the present invention.

Although the present invention is described herein with reference to multiple illustrative embodiments of the present invention, it should be understood that other modifications and implementations may be designed by those skilled in the art, and such modifications and implementations shall fall within the scope of the present invention. More specifically, various variations and improvements may be made to the components and/or layouts within the scope of the present invention. In addition, other applications of the present invention will be apparent to those skilled in the art.

We claim:

1. A connector for high-speed data transmission, comprising: a female element and a male element;

wherein the female element comprises a housing, a plurality of sheets and a first shielding plate;

the male element comprises a base, a differential signal contact and a second shielding plate;

at least two sheets are provided on the housing, and the first shielding plate is provided between adjacent sheets; the second shielding plate corresponding to the sheets is provided on the base; a signal pin is provided at a bottom of the sheets; the differential signal contact is provided in the base; the housing is fitted in the base; and the signal pin is configured to contact the differential signal contact;

a pin slot corresponding to the signal pin is provided on the base; an end slot corresponding to a shielding plate slot of the housing is provided on the base; and a mating portion is provided at a lower end of the first shielding plate; and the mating portion is inserted into the end slot through the shielding plate slot and contacts the second shielding plate;

the housing comprises a pin hole and a spacer which is arranged between the shielding plate slot and the pin hole; the signal pin penetrates through the pin hole; the first shielding plate penetrates through the shielding plate slot and the spacer is configured to insulate the signal pin from the first shielding plate;

the base is provided with a signal pin slot corresponding to an opening of the signal pin, and the differential signal contact is arranged in the signal pin slot; and the differential signal contact is L-shaped and comprises a first end portion and a second end portion the second end portion extended perpendicular from one end of the first end portion and being in a same plane; the second end portion perpendicularly contacts the signal pin; the second end portion matches the signal pin slot an upper end surface of the second end portion is flush with or lower than an opening of the signal pin slot and the first end portion extends towards a bottom of the base to connect with an external circuit.

2. The connector of claim 1, wherein the mating portion comprises a first arc and a second arc; the first arc is arranged in the shielding plate slot; and the second arc is inserted into the end slot through the shielding plate slot.

3. The connector of claim 1, wherein a protrusion is provided on an outer wall of the housing, and a groove is provided on a side wall of the base; wherein the protrusion is fitted in the groove.

* * * * *